US009008538B2

(12) United States Patent
Saito

(10) Patent No.: US 9,008,538 B2
(45) Date of Patent: Apr. 14, 2015

(54) IMAGE FORMING APPARATUS

(75) Inventor: Makoto Saito, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 149 days.

(21) Appl. No.: 13/614,921

(22) Filed: Sep. 13, 2012

(65) Prior Publication Data

US 2013/0077989 A1 Mar. 28, 2013

(30) Foreign Application Priority Data

Sep. 28, 2011 (JP) ..... 2011-212964

(51) Int. Cl.
*G03G 15/16* (2006.01)
*G03G 21/00* (2006.01)

(52) U.S. Cl.
CPC ..... *G03G 15/161* (2013.01); *G03G 15/168* (2013.01); *G03G 21/0011* (2013.01); *G03G 2215/1661* (2013.01); *G03G 2215/0129* (2013.01)

(58) Field of Classification Search
CPC ..... G03G 15/161; G03G 15/168; G03G 2221/0026; G03G 2221/0042; G03G 2221/1618; G03G 2215/1661; G03G 21/0011; G03G 21/007; G03G 21/12; G03G 21/0094
USPC ..... 399/101, 346, 350, 358–360, 123
See application file for complete search history.

(56) References Cited

U.S. PATENT DOCUMENTS

| | | | | |
|---|---|---|---|---|
| 6,060,205 | A * | 5/2000 | Takeichi et al. | 430/126.2 |
| 6,922,543 | B2 * | 7/2005 | Kanagawa | 399/350 |
| 7,022,450 | B2 * | 4/2006 | Asano et al. | 430/120.1 |
| 7,228,099 | B2 * | 6/2007 | Shintani et al. | 399/346 |
| 7,315,722 | B2 * | 1/2008 | Kitajima et al. | 399/353 |
| 7,493,075 | B2 * | 2/2009 | Shintani et al. | 399/346 |
| 7,953,363 | B2 * | 5/2011 | Honjoh et al. | 399/346 |
| 2004/0109711 | A1 * | 6/2004 | Kanagawa | 399/350 |
| 2008/0253815 | A1 * | 10/2008 | Yano et al. | 399/353 |
| 2009/0297972 | A1 * | 12/2009 | Sakimura et al. | 430/66 |
| 2010/0232843 | A1 * | 9/2010 | Kouno | 399/302 |

FOREIGN PATENT DOCUMENTS

| | | | |
|---|---|---|---|
| JP | 2001-337558 | A | 12/2001 |
| JP | 2004-4504 | A | 1/2004 |
| JP | 2004-21109 | A | 1/2004 |
| JP | 2004-334092 | A | 11/2004 |
| JP | 2007-241114 | A | 9/2007 |
| JP | 2010-217460 | A | 9/2010 |
| JP | 2012068466 | A * | 4/2012 |

* cited by examiner

*Primary Examiner* — David Gray
*Assistant Examiner* — Carla Therrien
(74) *Attorney, Agent, or Firm* — Canon U.S.A., Inc. IP Division

(57) ABSTRACT

An image forming apparatus includes a lubricant applying member located opposite a contact portion of a cleaning blade with an image bearing member below in the vertical direction, an opposed position of the lubricant applying member opposite the contact portion of the cleaning blade with the image bearing member below in the vertical direction being located upstream of a contact position of the lubricant applying member with a cleaning member in the rotational direction of the lubricant applying member, and a carrying member configured to carry the toner removed from the lubricant applying member, the carrying member being disposed at a position on a tangent to an outer circumference of the lubricant applying member at a contact position with the cleaning member and on a vertical line extending from a contact position of the lubricant applying member with a solid lubricant member.

6 Claims, 3 Drawing Sheets

IMAGE FORMING APPARATUS

BACKGROUND OF THE INVENTION

1. Field of the Invention

The present invention relates to an electrophotographic image forming apparatus and, in particular, to an image forming apparatus equipped with a cleaning blade.

2. Description of the Related Art

Conventionally, in an electrophotographic image forming apparatus, for example, an image bearing member bears a toner image thereon. The toner image on the image bearing member is eventually transferred and fixed to a recording material (e.g., recording paper and overhead projector (OHP) sheet) to be discharged from the image forming apparatus. The toner image on the image bearing member can be transferred to a recording material by a direct transfer method in which a toner image formed on a photosensitive member is directly transferred to the recording material. The transfer can be alternatively performed by an intermediate transfer method in which a toner image on a photosensitive member is first transferred to an intermediate transfer member and then a toner image on the intermediate transfer member is transferred to a recording material.

After an image bearing member such as the photosensitive member and the intermediate transfer member bears a toner image to transfer it to a material where the image is to be fixed, a certain amount of residual toner is left on the surface of the image bearing member without transfer. The residual toner requires cleaning of the surface of the image bearing member for preparation of subsequent image formation. A cleaning blade method has been widely used to remove the residual toner by placing a cleaning blade in contact with the surface of the image bearing member.

If the contact between the cleaning blade and the surface of the image bearing member causes too much friction, the contacting portion of the cleaning blade with the image bearing member may be bent over. Even if the contact portion is not bent, the surface of the image bearing member may be scraped off or scratched by the cleaning blade, leading to poor quality of resultant images. To avoid these damages, Japanese Patent Application Laid-Open No. 2007-241114 discusses a structure in which a lubricant is applied to an image bearing member to decrease surface energy of an image bearing member, resulting in a decrease in friction force between the surface of the image bearing member and a cleaning blade.

Japanese Patent Application Laid-Open No. 2004-334092 also discusses a structure with a cleaning blade and an elastic roller as a toner removing member to provide a long-term cleaning performance for toners including a polymerized toner. The cleaning blade is kept in contact with a photosensitive member drum, and the elastic roller is located upstream of the cleaning blade. A lubricant applying unit configured to apply a lubricant to the image bearing member is installed between the blade and the roller.

Unfortunately, such a structure where the lubricant applying unit configured to apply a lubricant to the image bearing member is placed at a distance from the cleaning blade requires a large space for the installation, which increases the size of the apparatus. On the contrary, a structure where a lubricant applying unit is placed close to a cleaning blade to avoid an increase in size of an apparatus may cause a problem that residues such as residual transfer toner and paper powder removed from the image bearing member by the cleaning blade fall and accumulate onto the lubricant applying unit. Any residue such as the toner fallen and accumulated onto the lubricant applying unit precludes an appropriate amount of application of a lubricant onto the image bearing member, which may cause poor or uneven application of the lubricant. Such application in turn may lead to cleaning defects such as bending or chattering of the cleaning blade.

Japanese Patent Application Laid-Open No. 2004-4504 discusses a structure which further includes a cleaning member to remove residues such that the residues such as residual transfer toner and paper powder removed from an image bearing member by a cleaning blade do not fall or accumulate onto a lubricant applying unit. The lubricant applying unit drops not only the toner removed by the cleaning member but a lubricant scraped off by the lubricant applying unit. This requires a conveying member in the structure to convey these residues. The removed toner and the lubricant are individually produced at different positions in a circumferential direction of the lubricant applying unit. Therefore, the position of the conveying member often causes a trouble in conveying one of the toner and the lubricant, or requires another member to convey both of the removed toner and lubricant.

SUMMARY OF THE INVENTION

The present invention is directed to an image forming apparatus that is capable of, without an increase in size, efficient conveying residues including removed toner and lubricant produced from a lubricant applying unit configured to apply a lubricant to an image bearing member.

According to an aspect of the present invention, an image forming apparatus includes a rotatable image bearing member, a cleaning blade configured to contact the image bearing member to remove toner remaining on the image bearing member, a lubricant applying member rotatably disposed below a contact portion of the cleaning blade with the image bearing member in a vertical direction and configured to apply a lubricant to the image bearing member at a position upstream of the cleaning blade in a rotational direction of the image bearing member, a solid lubricant member configured to contact the lubricant applying member to supply the lubricant to the lubricant applying member, a cleaning member configured to clean the lubricant applying member, the cleaning member disposed in contact with the lubricant applying member at a position downstream of an opposed position, in a rotational direction of the lubricant applying member, that is opposite the contact portion of the cleaning blade with the image bearing member below in the vertical direction, and a carrying member configured to carry the toner removed from the lubricant applying member, the carrying member disposed at a position on a tangent to an outer circumference of the lubricant applying member at a contact position with the cleaning member and on a vertical line extending from a contact position of the lubricant applying member with the solid lubricant member.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
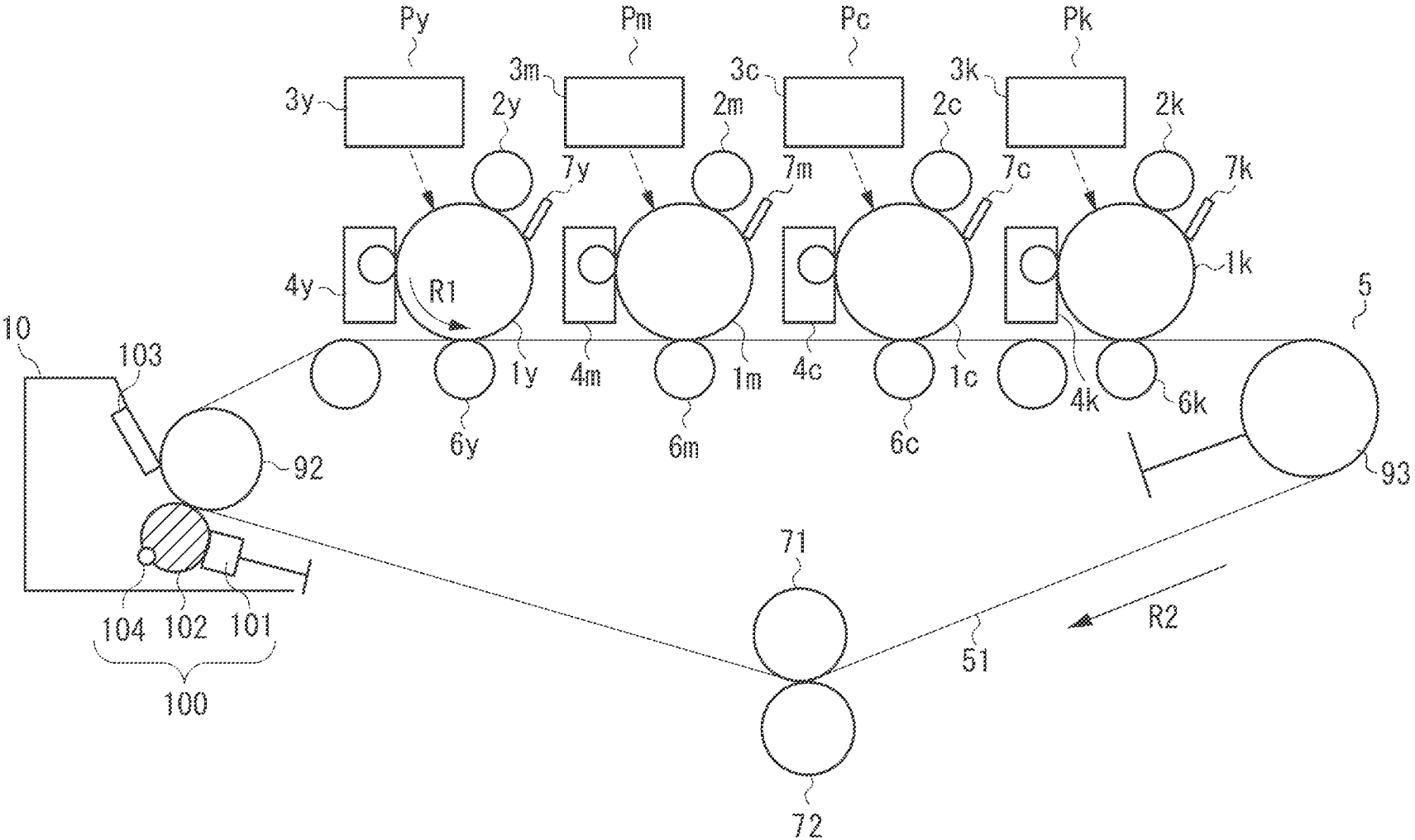
FIG. 1 is a cross sectional view illustrating an image forming apparatus according to a first exemplary embodiment of the present invention.

A first exemplary embodiment is described. FIG. 1 is a cross sectional view illustrating an image forming apparatus according to an exemplary embodiment of the present invention. The image forming apparatus of the present exemplary embodiment is a laser beam printer configured to form a full colored image onto a recording material (e.g., recording paper, an OHP sheet, a piece of fabric) using an electrophotographic method.

The image forming apparatus includes first to fourth image forming units (stations) P configured to form yellow, magenta, cyan, and black images, as image forming units to form toner images.

In the present exemplary embodiment, the image forming units have the same structure except the toner color to be used. Accordingly, these units are collectively described as image forming units P, omitting indexes y, m, c, and k from reference numeral for representation of the component for a certain color, unless any particular distinction is needed.

Each of the image forming units P each include a cylindrical photosensitive member as an image bearing member, that is, a photosensitive drum 1. In addition, around the photosensitive drum 1, the image forming units P each include a charging roller 2 as a charging unit, a laser beam scanner 3 as an exposure unit, a developing device 4 as a developing unit, and a photosensitive member cleaning device 7 as a cleaning unit.

Opposite the photosensitive drum 1 of each image forming section P, an intermediate transfer unit 5 is disposed. The intermediate transfer unit 5 includes an intermediate transfer belt 51 as an intermediate transfer member for the image bearing member bearing a toner image thereon. The intermediate transfer belt 51 is stretched around a plurality of support members including a driving roller 92, a stretching roller 93, a secondary transfer inner roller (inner roller) 71, and two idler rollers, and rotates therearound. Transmission of driving force to the driving roller 92 causes the intermediate transfer belt 51 to move around (rotate) in the direction indicated by the arrow R2 in FIG. 1.

On the inner surface of the intermediate transfer belt 51, primary transfer rollers 6*y*, 6*m*, 6*c*, and 6*k* are arranged as primary transfer units respectively opposite the photosensitive drums 1*y*, 1*m*, 1*c*, and to 1*k* of the image forming units 1. The primary transfer rollers 6*y* to 6*k* urge the intermediate transfer belt 51 toward the photosensitive drums 1*y* to 1*k* respectively, which forms primary transfer units (primary transfer nip sections) where the intermediate transfer belt 51 contacts the photosensitive drums 1.

A secondary transfer outer roller (outer roller) 72 is disposed opposite the inner roller 71 through the intermediate transfer belt 51. The intermediate transfer belt 51 is sandwiched between the inner roller 71 and the outer roller 72 which form a secondary transfer unit. The inner roller 71 contacts the inner surface of the intermediate transfer belt 51 and the outer roller 72 contacts the outer surface of the intermediate transfer belt 51.

An intermediate transfer member cleaning unit 10 as a cleaning apparatus of the intermediate transfer belt 51 includes a cleaning blade 103 and a lubricant applying unit 100. The lubricant applying unit 100 includes a solid lubricant member 101, a fur brush 102 as a lubricant applying member, and a cleaning member 104 to clean the lubricant left on the lubricant applying member 102.

Image forming operations of the image forming apparatus are described. The photosensitive drums 1 are driven to rotate at a predetermined circumferential velocity (processing speed) in the counterclockwise direction as indicated by the arrow R1 in FIG. 1. The surface of each of the photosensitive drums 1 is charged with a predetermined polarity and a potential (primary charge) by the corresponding charging roller 2 as a contact charging member.

The laser beam scanners 3 each emit a laser beam that is on-off modulated in response to image information input from an external apparatus such as an image scanner or a computer. The laser beam scanners 3 scan and expose the surfaces of the photosensitive drums 1 using the laser beams. The scanning and exposure by the laser beam scanners 3 forms electrostatic images (latent images) corresponding to the target image information on the photosensitive drums 1.

The electrostatic images on the photosensitive drums 1 are converted into visible toner images by the developing devices 4. In the present exemplary embodiment, the developing devices 4 each accommodate a two-component developer as a developer, containing a nonmagnetic toner and a magnetic carrier (a carrier). The developing devices 4 each include a developing sleeve as a developer bearing member disposed opposite the corresponding photosensitive drum 1. Each developing sleeve bears a magnetic brush for the developer. The developing sleeves supply the toner to development areas on the photosensitive drums 1 using the magnetic brushes, so that the electrostatic images on the photosensitive drums 1 are developed to the toner images.

The toner images formed on the photosensitive drums are electrostatically transferred (primary transfer) to the intermediate transfer belt 51 by the primary transfer rollers 6. During the primary transfer, a primary transfer bias source that serves as a primary transfer bias applying unit outputs a primary transfer bias, which is applied to the primary transfer rollers 6. The applied primary transfer bias in the present exemplary embodiment is a voltage of +900 V.

A residual toner (a primary transfer residual toner) left on the photosensitive drums 1 after the primary transfer is removed and collected by the photosensitive member cleaning devices 7. This removes the residual toner from the image bearing members to be used for next image formation. The photosensitive member cleaning devices 7 each include an urethane blade member having a thickness of 2 μm.

The above-described operations are performed in sequence at the first to fourth image forming units to form a full color image. Through the operations, the toner images of the four colors are individually transferred onto the intermediate transfer belt 51 at each of the primary transfer units.

In synchronization with the toner image formation on the intermediate transfer belt 51, a recording material is fed from the recording material feeding unit to a secondary transfer unit. The feeding of the recording material to the secondary transfer unit is timed to the toner image formation on intermediate transfer belt 51.

The toner images on the intermediate transfer belt 51 are electrostatically transferred to the recording material at the secondary transfer unit by an electric field generated between the inner and outer rollers 71 and 72. The electric field is generated between the inner and outer rollers 71 and 72 by applying a secondary transfer bias voltage to one of the inner and outer rollers 71 and 72. The secondary transfer bias is a voltage of 2.3 Kv applied to the outer roller 72 in the present exemplary embodiment. However, the secondary transfer bias is not limited thereto and any other voltage appropriate to an image forming apparatus may be used.

The recording material with the toner images transferred thereon at the secondary transfer unit is conveyed to a fixing device through a conveyance path (not illustrated), where the toner images on the recording material are turned to fixed images.

In the present exemplary embodiment, the intermediate transfer belt 51 is composed of a base layer, an elastic layer, and an outer layer. The base layer is a semiconductive polyimide resin having a dielectric constant of $\in$=3 to 5, a volume resistivity of $\rho v=10^6$ to $10^{11}$ Ωm, and a thickness of 85 μm. The elastic layer is a urethane rubber layer having a volume resistivity of $\rho v=10^6$ to $10^{11}$ Ωm and a thickness of 260 μm. The outer layer is a polyvinylidene fluoride (PVDF) resin having insulation properties and a thickness of 2 μm.

The primary transfer rollers 6 may be semiconductive ones having a resistance value of $10^2$ to $10^8\Omega$ with respect to an applied voltage of 2000 V. In the present exemplary embodiment, the primary transfer rollers 6 are ionic-conductive sponge rollers made of a composition of a nitrile rubber and an ethylene-epichlorohydrin copolymer, which has an outer diameter ϕ of 16 mm, and a cored bar diameter ϕ of 8 mm. The primary transfer rollers 6 in the present exemplary embodiment have a resistance value of about $10^6$ to $10^8\Omega$ (with respect to an applied voltage of 2 kV) at a temperature of 23° C. and a humidity of 50%.

The inner roller 71 is a semiconductive roller made of an ethylene propylene diene terpolymer (EPDM) rubber with a dispersed conductive carbon, which has an outer diameter ϕ of 20 mm and a cored bar diameter ϕ of 16 mm. The inner roller 71 has a resistance value of about 10 to $10^5\Omega$ (with respect to an applied voltage of 10 V) at a temperature of 23° C. and a humidity of 50% as measured under the conditions similar to those in the above case for the primary transfer rollers 6.

The outer roller 72 is an ion-conductive sponge roller made of a composition of a nitrile rubber and an ethylene-epichlorohydrin copolymer, which has an outer diameter ϕ of 24 mm and a cored bar diameter ϕ of 12 mm. The outer roller 7 has a resistance value of about $10^6$ to $10^8\Omega$ (with respect to an applied voltage of 2 kV) at a temperature of 23° C. and a humidity of 50% as measured under the conditions similar to those in the above cases.

In the present exemplary embodiment, the intermediate transfer member cleaning unit 10 as a cleaning apparatus of the intermediate transfer belt 51 includes the cleaning blade 103 and the lubricant applying unit 100. The intermediate transfer member cleaning unit 10 may include only the cleaning blade 103, and the lubricant applying unit 100 may be provided as a separate unit.

In the present exemplary embodiment, the cleaning blade 103 is an urethane blade member having a thickness of 2 μm. The blade member is attached to a support plate. The cleaning blade 103 has a free length of 8 mm that is not attached to the support plate.

The cleaning blade 103 in the present exemplary embodiment is pressed toward the intermediate transfer belt 51 by a pressing mechanism (not illustrated) under a pressure of 1.1 kgf. The cleaning blade 103 is in contact with the intermediate transfer belt 51 at an angle of 17 degrees relative to a tangent at a contact portion of the cleaning blade 103 with the intermediate transfer belt 51.

The lubricant in the present exemplary embodiment is solid zinc stearate. The lubricant may be a fatty acid metal salt. The fatty acid may be stearic acid, palmitic acid, myristic acid, or oleic acid. The metal salt may be zinc, iron, aluminum, lead, magnesium, or calcium.

The lubricant applying member 102 is a rotatable fur brush. The fur brush has threads of a 5-mm length and a 6.25-denier thickness, and a cored bar diameter of 8 mm. The lubricant applying member 102 is disposed, with respect to the intermediate transfer belt 51, at a position opposite the intermediate transfer belt driving roller 92 so that a distance between the driving roller 92 and the axis of the fur brush 102 is fixed and also the lubricant applying member 102 approaches to the intermediate transfer belt 51 at a fixed distance of 1 mm. The fur brush 102 is disposed at a lubricant application position located upstream of the cleaning blade 103 in the rotational direction of the intermediate transfer belt 51. The fur brush 102 is in contact with the lubricant 101 at a lubricant contact position located upstream of the lubricant application position, where the fur brush 102 contacts the intermediate transfer belt 51, in the rotational direction of the fur brush 102 to scrape the lubricant 101 and also to apply the lubricant to the intermediate transfer belt 51 while rotating.

The zinc stearate as the solid lubricant member 101 is pressed against the fur brush 102 by a pressing mechanism (not illustrated). In the present exemplary embodiment, the zinc stearate is pressed under a consistent pressure of 0.4 kgf. The pressure is maintained at the fixed level because a remained volume of the zinc stearate as the solid lubricant member 101 is decreased as consumed and the zinc stearate needs to be kept pressed under a predetermined pressure to be in contact with the fur brush 102.

The fur brush 102 is disposed at a position approaching the intermediate transfer belt 51 by a fixed distance to be kept in contact with the belt 51. Even if a fixed pressure is applied to the fur brush 102, because the fur brush 102 presses the intermediate transfer belt 51 while being pressed by the solid zinc stearate 101, the pressure may be unstable. Accordingly, in the present exemplary embodiment, the approach distance of the fur brush 102 to the intermediate transfer belt 51 is fixed. However, instead of the approach distance, the pressure applied by the fur brush 102 to the intermediate transfer belt 51 may be fixed.

The fur brush 102 as the lubricant applying member receives driving force from a gear (not illustrated) disposed at a shaft of the intermediate transfer belt driving roller 92 to be driven to rotate in the forward direction relative to the running direction of the intermediate transfer belt 51. The fur brush 102 is driven to rotate at a circumferential speed lower than the moving speed (rotation speed) of the intermediate transfer belt 51. In the present exemplary embodiment, the fur brush 102 is set to rotate at a circumferential speed of 104 mm/sec while the intermediate transfer belt 51 moves at a moving speed of 348 mm/sec.

Figure 2:
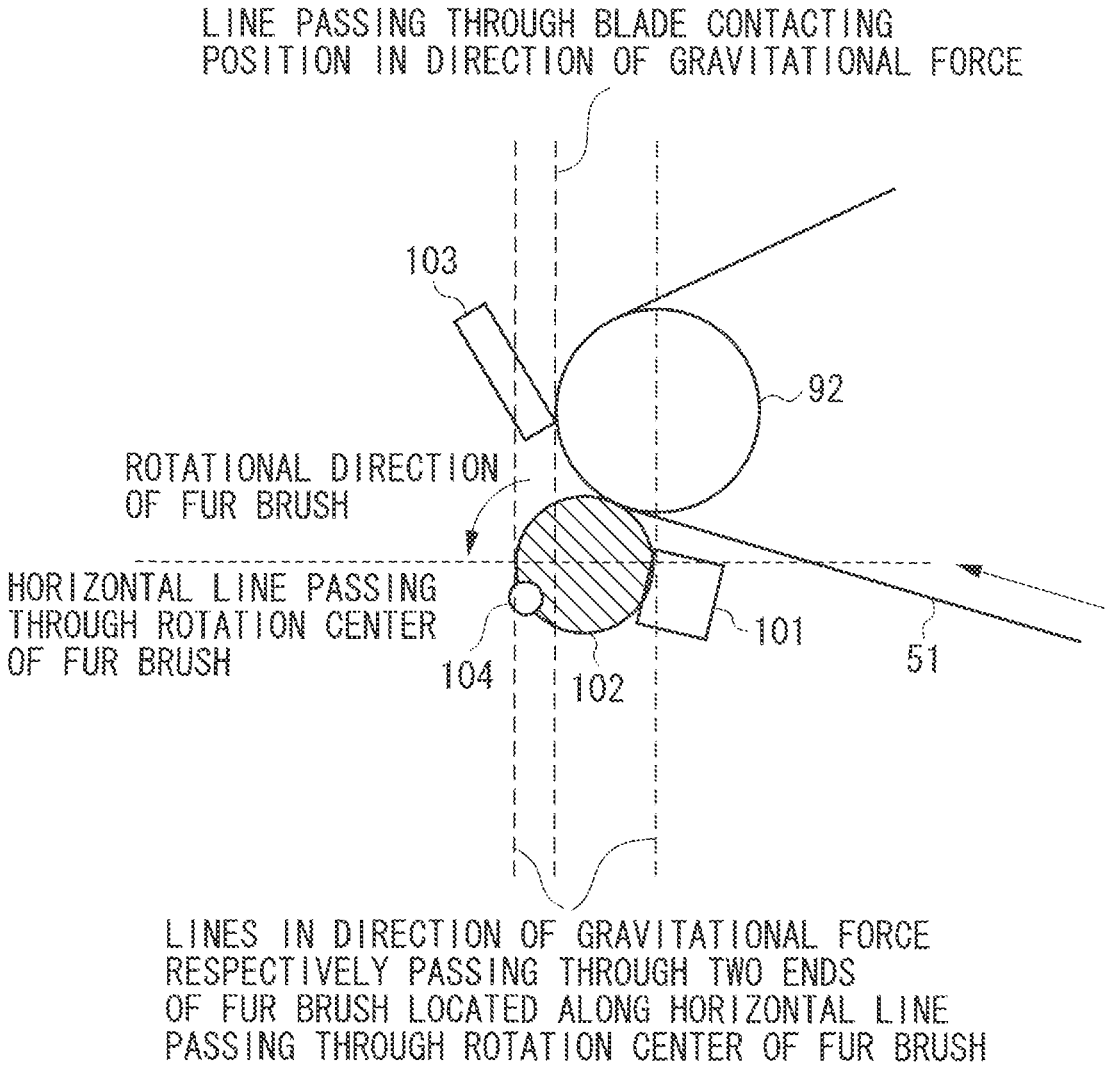
FIG. 2 illustrates a lubricant applying unit according to the first exemplary embodiment of the present invention.

FIG. 2 illustrates the lubricant applying unit.

In the present exemplary embodiment, the fur brush 102 as the lubricant applying member is disposed below the cleaning blade 103 below in the direction of gravitational force. As illustrated in FIG. 2, assume that a straight line is drawn in the direction of gravitational force (in the vertical direction) to pass through the contact portion (nip section) of the cleaning blade 103 where the cleaning blade 103 contacts the intermediate transfer belt 51, and two vertical straight lines are drawn to pass respectively through two ends of the fur brush 102, the two ends being located along a horizontal straight line passing through the rotational center of the fur brush 102 in the lateral direction. In this case, the fur brush 102 is arranged such that the straight line in the direction of gravitational force that passes through the contact portion where the cleaning blade 103 contacts the intermediate transfer belt 51 is interposed between the two lines passing through the two ends of the fur brush 102 in the vertical direction. In other words, the fur brush 102 as the lubricant applying member is placed opposite the contact portion where the cleaning blade 103 contacts the intermediate transfer belt 51 below in the vertical direction. The vertical arrangement of the cleaning blade 103 and the lubricant applying member enables downsizing of the apparatus.

However, the residues such as the residual transfer toner removed from the intermediate transfer belt 51 at the contact portion with the cleaning blade 103 freely fall by gravity, and are collected by the fur brush 102. In other words, the freely fallen residual toner and paper powder removed by the cleaning blade 103 accumulate onto part of the fur brush 102 located opposite the nip section of the cleaning blade 103 below in the vertical direction.

If the residual toner and paper powder, after removal by the cleaning blade 103, fall and accumulate onto the rotating fur brush 102, the fur brush 102 can no longer apply an appropriate amount of the lubricant 101 to the intermediate transfer belt 51, which may cause poor or uneven application of the lubricant 101. Such application in turn may lead to cleaning defects such as bending or chattering of the cleaning blade 103. This is because the fur brush 102 having the residual transfer toner thereon cannot scrape a sufficient amount of the lubricant 101. Any toner at the contact position between the solid lubricant member 101 and the fur brush 102 prevents the leading edge of the fur brush 102 from contacting the solid lubricant 101 leading to insufficient friction force applied to the solid lubricant member 101 by the fur brush 102. As a result, the lubricant at the portion of the fur brush 102 having the toner thereon cannot be sufficiently scraped off. In particular, a secondary transfer residual toner is a mixture of residual transfer toners for various toner images, and thereby remains unevenly on the fur brush 102 in the longitudinal direction, which may directly cause uneven application of the lubricant 101.

Accordingly, in the structure of the present exemplary embodiment, the fur brush 102 is located opposite the contact portion of the cleaning blade 103 below in the vertical direction. Furthermore, the portion of the fur brush 102 located opposite to the contact portion of the cleaning blade 103 below in the vertical direction is disposed upstream of the contact position with the cleaning member 104 in the rotational direction of the fur brush 102. This structure enables residues such as toner that fall onto the fur brush 102 and are collected to be removed by the cleaning member 104 that cleans the fur brush 102 as the fur brush 102 rotates. When part of the fur brush 102 rotates to the approach position of the cleaning member 104, the cleaning member 104 reaches the deeper portion of the threads of the fur brush 102 and shakes off the fur brush 102 to remove the residues such as the residual transfer toner once collected by the part of fur brush 102. In other words, the residual transfer toner once collected by the fur brush 102 is shaken off from the fur brush 102 by the cleaning member 104, which enables removal of the toner accumulated on the fur brush 102 and an extra amount of the lubricant.

The cleaning member 104 in the present exemplary embodiment is a stainless steel (SUS) rod member having a 4-mm diameter. The cleaning member 104 is fixedly disposed at a position inside the leading edges of the threads of the fur brush 102 by 1 mm.

The fur brush 102 is in contact with the solid lubricant member 101 to continuously apply the lubricant to the intermediate transfer belt 51. As a result, the fur brush 102 also collects part of the secondary transfer residual toner attached to the intermediate transfer belt 51. In addition, the fur brush 102 collects the residual transfer toner freely fallen from the cleaning blade 103.

Therefore, the cleaning member 104 is disposed on the downstream side of the contact portion between the fur brush 102 and the intermediate transfer belt 51 in the rotational direction of the fur brush 102, and the solid lubricant member 101 is disposed, in the rotational direction of the fur brush 102, on the downstream side of the position where the cleaning member 104 approaches the fur brush 102. The portion of the fur brush 102 located opposite the contact portion of the cleaning blade 103 with the intermediate transfer belt 51 below in the vertical direction is disposed on the upstream side of the contact portion of the fur brush 102 with the intermediate transfer belt 51 in the rotational direction. This structure enables the cleaning member 104 to clean the fur brush 102 having thereon the residues such as the residual transfer toner removed by the fur brush 102 from the intermediate transfer belt 51 and the collected toner freely fallen from the cleaning blade 103. The cleaned fur brush 102 is then used again to scrape off the lubricant, which prevents an increase in size of the apparatus and poor and uneven application of the lubricant 101.

The cleaning blade 103 and the fur brush 102 are placed against the intermediate transfer belt 51 under a pressure, and thereby an opposing member can be arranged to the back surface of the intermediate transfer belt 51 to support them.

The present exemplary embodiment is applicable not only to a lubricant applying unit configured to apply a lubricant to an intermediate transfer belt, but to a lubricant applying unit configured to apply a lubricant to a photosensitive member drum or a photosensitive member belt. In the latter case, the lubricant is disposed at a photosensitive member cleaning blade below in the direction of gravitational force.

A second exemplary embodiment is described below. An image forming apparatus and other structure of the present exemplary embodiment are similar to those in the first exemplary embodiment, which will not be described. Only characteristics of the present exemplary embodiment are described.

The present exemplary embodiment is characterized by a structure in which residues such as residual transfer toner shaken off from a fur brush 102 by a cleaning member 104 are removed to be straightly directed to a carrying screw 105 of an intermediate transfer cleaning device 10. This structure enables removal of the toner and lubricant removed from the fur brush 102 without dissipation of the residues toward the solid lubricant member 101 and its surrounding area.

Figure 3:
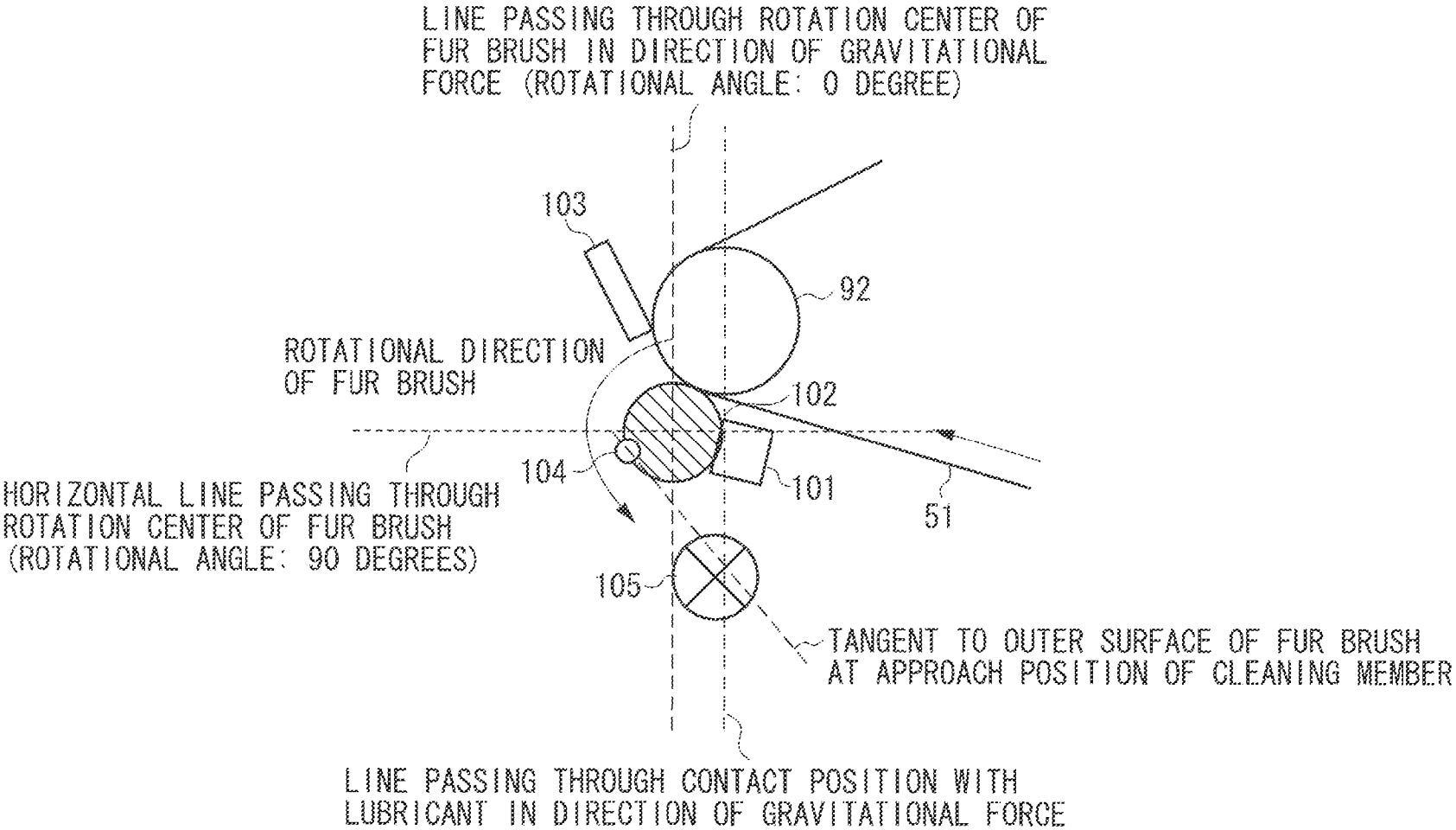
FIG. 3 illustrates a lubricant applying unit according to a second exemplary embodiment of the present invention.

FIG. 3 illustrates a lubricant applying unit 100 according to the present exemplary embodiment. As illustrated in FIG. 3, the carrying screw 105 is disposed, as a carrying member configured to carry collected toner, at a position almost below the fur brush 102 and the lubricant 101, so that the toner collected from the intermediate transfer belt 51 is carried. The arrangement of the carrying screw 105, the fur brush 102, the cleaning member 104, and the lubricant 101 is described in detail In the present exemplary embodiment, assume that a perpendicular line is drawn passing through the rotational center of the fur brush 102 in the direction of gravitational force relative to the rotation axis of the fur brush 102. The perpendicular line extended upward from the rotation center of the fur brush 102 represents a 0-degree rotation angle of the fur brush 102 that rotates counterclockwise. In this structure, a lubricant application position where the lubricant is applied to the intermediate transfer belt 51 is disposed at a rotation angle of the fur brush 102 of between 270 degrees and 360 degrees of the fourth quadrant. The cleaning member 104 can be disposed at a rotation angle of the fur brush 102 between 90 degrees and 135 degrees inclusive. In the present exemplary embodiment, the cleaning member 104 is disposed at an angle of 115 degrees. The zinc stearate 101 can be disposed at an angle equal to or greater than 225 degrees. In the present exemplary embodiment, the zinc stearate 101 is disposed at an angle of 252 degrees.

The toner collected and accumulating on the fur brush 102 is shaken off by the cleaning member 104 to clean the fur brush 102. The toner collected by the fur brush 102 and shaken off from the fur brush 102 is discharged, as illustrated in FIG. 3, in the direction of the tangent to the outer surface of the fur brush 102 at the approach position (contact position) of the cleaning member 104 to the fur brush 102. The direction of the tangent to the outer surface of the fur brush 102 at the approach position is set to run into the carrying screw 105 that carries the collected toner. In other words, the carrying screw 105 is located in the direction where the collected toner is discharged. In addition, at the lubricant contact position where the fur brush 102 contacts the lubricant 101, scraped powder of the lubricant may fall down. Thus, the carrying screw 105 that carries the collected toner can be disposed almost below the lubricant contact position, where the fur brush 102 contacts the zinc stearate 101, in the vertical direction of gravitational force. As a result, the cleaning member 104 can be located at a rotation angle of the fur brush 102 equal to or greater than 90 degrees. If the cleaning member 104 is located at a rotation angle of the fur brush 102 less than 90 degrees, the perpendicular line passing through the contact position where the fur brush 102 contacts the zinc stearate 101 in the direction of gravitational force does not come across the tangent to the contact position of the fur brush 102 with the cleaning member 104. This precludes simultaneous collection of the collected toner and the scraped zinc stearate powder by the single carrying screw 105. As a result, a plurality of screws is required, which makes the structure of the apparatus complicated.

The cleaning member 104 can be located at a rotation angle of the fur brush 102 of less than 135 degrees. If the cleaning member 104 is placed at a rotation angle of the fur brush 102 equal to or greater than 135 degrees, the tangent at the contact position of the cleaning member 104 with the fur brush 102 crosses with the perpendicular line passing through the contact position of the fur brush 102 with the zinc stearate 101 at an upper position, which decreases the distance between the carrying screw 105 and the zinc stearate 101. Such a decreased distance may cause the collected toner, after drawn into the carrying screw 105, to directly contaminate the zinc stearate 101.

The zinc stearate 101 can be disposed at a rotation angle of the fur brush 102 equal to or more than 225 degrees. This structure can prevent direct contamination of the zinc stearate 101 by the collected toner after shaken off from the fur brush 102 by the cleaning member 104.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-212964 filed Sep. 28, 2011, which is hereby incorporated by reference herein in its entirety.

What is claimed is:

1. An image forming apparatus comprising:

a rotatable image bearing member;

a cleaning blade configured to contact the image bearing member to remove toner remaining on the image bearing member;

a lubricant applying member rotatably disposed below a contact portion of the cleaning blade with the image bearing member in a vertical direction and configured to apply a lubricant to the image bearing member at an applying position upstream of the cleaning blade in a rotational direction of the image bearing member;

a solid lubricant member disposed in contact with the lubricant applying member at a position upstream of the applying position in a rotatable direction of the lubricant applying member and configured to apply a lubricant to the lubricant applying member;

a cleaning member configured to clean the lubricant applying member, wherein the cleaning member is disposed below a horizontal straight line passing through a rotational center of the lubricant applying member and is in contact with the lubricant applying member at a position upstream of the solid lubricant member in the rotatable direction of the lubricant applying member; and a carrying member configured to carry the toner removed from the lubricant applying member, the carrying member disposed at a position on a tangent to an outer circumference of the lubricant applying member at a contact position with the cleaning member and on a vertical line extending from a contact position of the lubricant applying member with the solid lubricant member.

2. The image forming apparatus according to claim 1, wherein the toner removed from the image bearing member by the cleaning blade falls onto the lubricant applying member to be collected, and is then removed by the cleaning member from the lubricant applying member.

3. The image forming apparatus according to claim 1, wherein the lubricant applying member is a fur brush, and the cleaning member is a rod member located at a position inside a leading edge of the lubricant applying member.

4. The image forming apparatus according to claim 1, wherein, when a perpendicular line extended upward from a rotation center of the lubricant applying member represents a 0-degree rotational angle of the lubricant applying member in the rotational direction thereof, the cleaning member is located at an angle of between 90 degrees to 135 degrees inclusive, and the solid lubricant member is located at an angle equal to or greater than 225 degrees.

5. The image forming apparatus according to claim 1, wherein the image bearing member is an intermediate transfer belt including an elastic layer and configured to transfer a toner image borne thereon to a recording material.

6. An image forming apparatus comprising:

a rotatable image bearing member;

a cleaning blade configured to contact the image bearing member to remove toner remaining on the image bearing member;

a lubricant applying member rotatably disposed below a contact portion of the cleaning blade with the image bearing member and configured to apply a lubricant to the image bearing member at an applying position upstream of the cleaning blade in a rotational direction of the image bearing member;

a solid lubricant member disposed in contact with the lubricant applying member at a position upstream of the applying position in a rotatable direction of the lubricant applying member and configured to apply a lubricant to the lubricant applying member;

a cleaning member configured to clean the lubricant applying member, the cleaning member disposed in contact with the lubricant applying member; and a carrying member configured to carry the toner removed from the lubricant applying member, wherein when a perpendicular line extended upward from a rotation center of the lubricant applying member represents a 0-degree rotational angle of the lubricant applying member in the rotational direction thereof, the cleaning member is located at an angle of between 90 degrees to 135 degrees inclusive, and the solid lubricant member is located at an angle equal to or greater than 225 degrees.

* * * * *